United States Patent [19]

Thompson

[11] Patent Number: 4,906,168

[45] Date of Patent: Mar. 6, 1990

[54] PERISTALTIC PUMP

[76] Inventor: Ronald E. Thompson, 781 Durham Rd., Madison, Conn. 06443

[21] Appl. No.: 306,984

[22] Filed: Feb. 6, 1989

[51] Int. Cl.[4] ..... F04B 43/12

[52] U.S. Cl. ..... 417/477; 417/476

[58] Field of Search ..... 417/474, 475, 476, 477

[56] References Cited

U.S. PATENT DOCUMENTS

| | | | |
|---|---|---|---|
| 2,651,264 | 9/1953 | Bruckmann . | |
| 2,899,905 | 8/1959 | Becher . | |
| 2,958,294 | 11/1960 | Johnson . | |
| 3,972,649 | 8/1976 | Jutte | 417/477 X |
| 4,380,236 | 4/1983 | Norton | 417/476 X |
| 4,445,826 | 5/1984 | Tarr | 417/476 |
| 4,496,295 | 1/1985 | King . | |

*Primary Examiner*—Leonard E. Smith
*Assistant Examiner*—Eugene L. Szczecina, Jr.
*Attorney, Agent, or Firm*—DeLio & Associates

[57] ABSTRACT

A peristaltic pump which utilizes a length of elastic tubing in effecting pumping action comprising a frame; a pumping chamber on the frame including peristaltic pumping means for progressively squeezing and releasing consecutive portions of an intermediate section of the tubing to pump fluid in the tubing in a predetermined direction; and tubing feeding means on the frame comprising gripping means to engage the outer periphery of the tubing, on at least one section adjacent to the tubing intermediate section, and feed the tubing through the pumping chamber in the predetermined direction at a controlled rate during pumping of the fluid. Preferably, the means to engage and feed the tubing comprises a powered wheel or roller mechanism having a friction gripping surface to controllably feed the tubing into the pump chamber. The roller may be configured to engage both tubing being fed into and tubing being fed out of the pump chamber.

13 Claims, 2 Drawing Sheets

FIG. 2
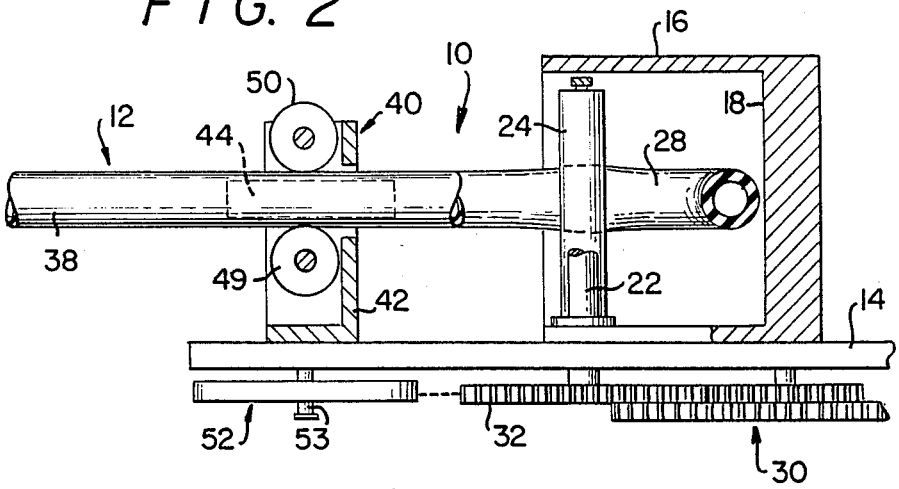
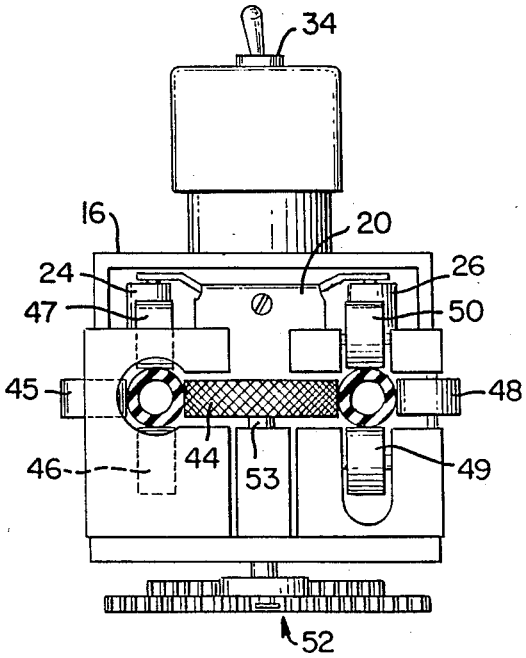
FIG. 3

PERISTALTIC PUMP

BACKGROUND OF THE INVENTION

This invention relates to an improved peristaltic pump in which fluid is pumped through a flexible hose by alternately squeezing and releasing progressive sections of the tubing.

Peristaltic pumps have been known for many years, and the prior art is replete with examples of various configurations of these pumps, which are also known variously as hose type or roller pumps. These pumps operate by holding a flexible elastic tube against a wall element in a pump chamber and progressively pinching or squeezing sections of the tube against the wall section with a cam or roller. Fluid ahead of the pinched tube section is displaced from the discharge end of the tube while the expansion of the tube in the wake of the pinched section creates a suction which draws more fluid into the intake end of the tube. The repeated pinching and releasing of the tubing creates stresses and wear such that eventually the tubing wears out. While the working lifetime of the flexible tubing can be extended by judicious selection of tubing materials, pump configuration, size and other factors, invariably the tube section in the pump chamber must be replaced. The lifetime of tubes ranges from several hours and up depending on the type of liquid being pumped and also the aforementioned factors of tubing material, pump configuration, etc. Various peristaltic pump configurations are shown in U.S. Pat. Nos. 4,496,295; 4,445,826; 2,651,2 64; 2,899,905; 2,958,294; and 4,380,236.

In many peristaltic pumps, the tubing section within the pump chamber is designed to remain stationary. It has been recognized that there is some tendency for the tube to creep relative to the pump chamber wall section due to the friction generated during movement of the cam or roller against the wall section. Some of the prior art patents have incorporated features to eliminate such tubing creep such as those described in U.S. Pat. No. 2,651,264. In other patents, the tubing is intentionally moved during the pumping action, such as in U.S. Pat. Nos. 4,380,236; 4,445,826; and 3,972,649. In the latter patent, an excess portion of tube is coiled around a rotating drum and fed through a pump chamber as the pumping action is applied. However, this method relies on an awkward and needlessly complex method of storing and feeding the tubes into the pump chamber.

Bearing in mind the deficiencies of the prior art, it is therefore an object of the present invention to provide a peristaltic pump which extends the working life of the tubing and requires less tubing changeover as a result of tube wear.

It is another object of the present invention to provide peristaltic pump in which fresh sections of tubing are continuingly feed into the pump chamber to replace worn sections.

It is a further object of the present invention to provide a tube feeding means for a peristaltic pump which operates in a simple yet efficient manner.

It is yet another object of the present invention to provide a peristaltic pump which is relatively simple, inexpensive and easy to manufacture.

SUMMARY OF THE INVENTION

The above and other objects, which will be apparent to those skilled in the art, are achieved in the present invention which provides a peristaltic pump which utilizes a length of elastic tubing in effecting pumping action comprising a frame; a pumping chamber on the frame including peristaltic pumping means for progressively squeezing and releasing consecutive portions of an intermediate section of the tubing to pump fluid in the tubing in a predetermined direction; and tubing feeding means on the frame comprising gripping means to engage the outer periphery of the tubing, on at least one section adjacent to the tubing intermediate section, and feed the tubing through the pumping chamber in the predetermined direction at a controlled rate during pumping of the fluid.

Preferably, the means to engage and feed the tubing comprises a powered wheel or roller mechanism having a friction gripping surface to controllably feed the tubing into the pump chamber. The roller may be configured to engage both tubing being fed into and tubing being fed out of the pump chamber.

BRIEF DESCRIPTION OF THE DRAWINGS

FIG. 2 is a side elevational view, partially cut away and partially in section, of the peristaltic pump along line 2—2 in FIG. 1.

FIG. 3 is an end elevational view, partially cut away and partially in section, of the peristaltic pump along line 3—3 of FIG. 1.

DETAILED DESCRIPTION OF THE INVENTION

Figure 1:
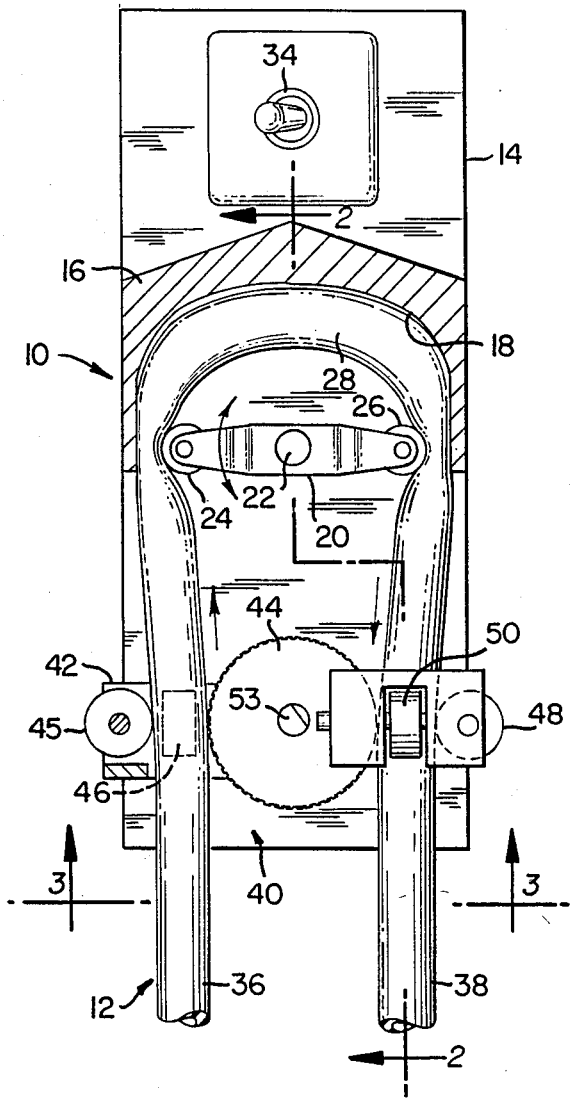
FIG. 1 is a top plan view, partially cut away and partially in section, of the peristaltic pump of the present invention.

The preferred embodiment of the present invention is shown in FIGS. 1-3 which illustrate the peristaltic pump in various sectional views. Like features are indicated by like numerals throughout the drawings. With the exception of the tubing, which is preferably made of a flexible, resilient, elastomeric material, the peristaltic pump is made of conventional steel, aluminum plastic or other structural materials.

As seen best in FIGS. 1 and 2, the peristaltic pump 10 includes a base or frame 14 upon which is disposed a pump housing 16 containing pumping chamber 19. Chamber 19 is bounded by a vertical wall section 18 which is arcuate in the plan view shown in FIG. 1 and which wraps in a semicircle shape around at least 180° of the interior of housing 16. A length of tubing 12 is disposed such that an intermediate section 28 is contained within pump chamber 19. Intermediate section 28 is disposed against wall 18 and conforms to the semicircular shape thereof.

Pumping is effected by the action of rotor 20 against tubing section 28 to progressively squeeze and release consecutive portions of tubing section 28. Rotor 20 is mounted on a spindle 22 and includes at its two opposite ends cylindrical rollers 24 and 26 which clampingly engage tubing 28. Rotor 20 and pump chamber wall 18 are configured so that, as rotor 20 turns, one of the rollers 24 or 26 engages and squeezes tubing section 28 against wall 18 before the other of the rollers 26 or 24 releases tubing section 28. Rotor 20 may rotate either clockwise or counterclockwise direction, as indicated by the arrows. As seen best in FIG. 2, spindle 22 is connected by a shaft to a rotor gear 32 which in turn forms part of a motor gear drive 30 depending from an electric motor (not shown). Operation of this pump drive 30 is controlled by on/off switch 34.

To provide means to controllably feed tubing 12 through pump chamber 19 during operation of the pump 10, there is provided a tube feeding means 40. Included in tube feeding means 40 is a central gripping wheel or rotor 44 mounted on base 42 (secured to frame 14) for rotation in a horizontal plane. Circular wheel 44 has upon its outer periphery a rough knurled surface to provide a gripping action to engage and drive tubing 12. Wheel 44 is mounted on a shaft 53 which controllably drives the wheel. Shaft 53, parallel to pump rotor spindle 22, rotates wheel 44 in the same plane of rotation as pump rotor 20. Wheel 44 is positioned between essentially parallel sections 58 and 60 of tubing 12 which are adjacent to the tubing section in the pump chamber and which extend out of pump chamber 19 on either end of intermediate tubing section 28.

As best seen in FIG. 3, idler rollers 45, 46 and 47 respectively provide side, upper and lower guides for tubing section 60 to ensure driving engagement with the knurled surface of wheel 44. Likewise, idler rollers 48, 50 and 49 respectively provide side, upper and lower guides for tubing section 58 to hold this section in driving engagement with wheel 44. Some compression of the tubing sections 58 and 60 may take place as a result of engagement with the wheel 44 and idler rollers, but the cross sectional area of the tubing interior channel should not be significantly reduced.

A drive mechanism 52 is connected to shaft 53 to rotate wheel 44 and drive tubing sections 58 and 60 in opposite directions. Tubing feed drive 52 may be powered by its own independent clockwork type motor which feeds tubing 12 only during the time that peristaltic pump 10 is in pumping operation. Alternatively, tube feed drive 52 may be drivingly connected by drive control means 54 to the pump motor drive mechanism 30 by gear reduction or other control mechanism to power the tube feed drive.

During operation of pump 10, one end of tubing 12 is connected to a source of liquid to be pumped while the other opposite end is connected to a liquid discharge or collection area. While pump 10 may be configured to be able to pump fluids in either direction, for convenience of description herein, tube end 36 will be designated as the inlet end for the liquid to be pumped while tube end 38 will be designated as the discharge or outlet end for the liquid. Upon engaging switch 34 in the On position, rotor 20 rotates in a clockwise direction such that the rollers 24 and 26 progressively squeeze consecutive sections of tubing section 28 against wall 18. The portion of tubing section 28 engaged by rollers 24 and 26 is completely pinched off or sealed in the interior by the clamping action of the rollers 24, 26. As the roller 24 or 26 advances the pinched sections 25 and 27, respectively, liquid in tube 12 is pushed and displaced toward and out of the discharge end 38. In the wake of the advancing pinched section, tubing 12 elasticly expands to its original shape thereby creating a suction which draws in new liquid through inlet end 36 to the area behind the pinched section. Thus, the progressive rotation of rotor 20 and alternate squeezing and releasing of consecutive portions of the tubing against the wall section effects the peristaltic pumping action of pump 10.

During the period when rotor 20 is rotating clockwise to effect the peristaltic pumping action, tubing feed wheel 44 is likewise rotating in a clockwise direction, although at a considerably slower rate, to push tubing section 60 into and pull tubing section 58 out of pump chamber 19 in the direction shown by arrows 56. Each tubing section 60 and 58 is held by the respective idler rollers firmly against the outer walls of tubing 12 so that sufficient friction is developed there between to drive the tubing section. However, the engagement of the respective rollers against the tubing sections 60 and 58 should not be such that the tubing is collapsed or the flow of liquid within the tubing sections is materially impeded. Tubing section 60 is fed at a controlled rate toward and into pump chamber 19 while tubing section 58 is fed out of the pump chamber at the same rate. The rate of tubing advance into and out of pump chamber 19 may be set to correspond to the expected tubing life cycle within pump chamber 19. In some extreme examples, tubing working life in pump chamber 19 may be only four pumping hours or less, in which case the drive rate of wheel 44 must be set to completely move a length of tubing corresponding to the length of section 28 within pump chamber 19 within that given time period. At the other extreme, tubing working life may be on the order of tens or hundreds of hours or even more, in which case the drive rate of wheel 44 is reduced accordingly. The length of tubing at ends 36 and 38 may be adjusted, given a desired tubing feed rate, to provide sufficient tubing length for a desired period of time before it becomes necessary to replace tubing 12 in pump 10.

In the majority of instances, although there is some tendency of tubing 12 to creep on its own in the direction of pumping, it is necessary to provide additional feed by tubing means 40 to adequately replace worn tubing sections within pump cavity 19 before the expiration of their working life. In these instances, wheel 44 pushes tubing section 60 and pulls tubing section 58 respectively into and out of pump chamber 19, placing the portion of tubing section 60 between wheel 44 and the pump chamber under compression and the portion of tubing section 58 between the pump chamber and wheel 44 under tension. In some other instances, however, the rate of tubing creep through pump chamber 19 results in tubing replacement within that chamber well before the working life of the tube section and, accordingly, tube feeding means 40 may be used as a controlled brake or drag on the rate of advance of tubing 12 to control and reduce the excessive creep to a desired rate. In this latter case, the portion of tubing section 60 between wheel 44 and the pump chamber will be under slight tension while the portion of tubing section 58 between the pump chamber and wheel 44 will be under slight compression.

The ability of tube feeding means 40 to engage and drive tubing 12 on both the entering and exiting section of the pump chamber provides significantly greater control over tube feeding than was heretofore possible by sections of the tubing tends to reduce the overall stretching of the tubing in the section under tension, which may be either the section entering the pump chamber or the section exiting the pump chamber, depending on the degree of tube creep imparted by rotor 20. Thus, the forces on tubing 12 tend to be more balanced and, consequently, tubing 12 is more controllable. Thus, the tube feed drive 40 acts as an escapement for tubing 12 during operation of pump 10. Furthermore, use of the present invention can greatly extend tube life, depending on the length of tube provided, to 10 or more times between tube changeover, at only moderate cost.

While this invention has been described with reference to a specific embodiment, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A peristaltic pump which utilizes a length of elastic tubing in effecting pumping action comprising:
   a frame;
   a pumping chamber on said frame including peristaltic pumping means for progressively squeezing and releasing consecutive portions of an intermediate section of said tubing to pump fluid in said tubing in a predetermined direction; and
   tubing feeding means on said frame comprising powered frictional gripping means to engage the outer periphery of said tubing, on a section adjacent to said tubing intermediate section, and feed said tubing through said feeding means and said pumping chamber is said predetermined direction at a controlled rate during pumping of said fluid.

2. The peristaltic pump of claim I wherein said tubing feeding means is powered and engages said tubing on sections adjacent to either side of said tubing intermediate section to feed one of said adjacent tubing sections into said pumping chamber and to feed the other of said adjacent tubing sections out of said pumping chamber.

3. The peristaltic pump of claim 1 wherein said tubing feeding means is operable to control the tubing feeding rate independently of said peristaltic pumping means.

4. The peristaltic pump of claim 1 wherein said tubing gripping means comprises a frictionally engaging powered wheel for contacting said outer periphery of said tubing.

5. The peristaltic pump of claim 2 wherein said tubing gripping means comprises a frictionally engaged powered wheel for contacting said outer periphery of said tubing on sections adjacent to either side of said tubing intermediate section.

6. A peristaltic pump which utilizes a length of elastic tubing in effecting pumping action comprising:
   a frame;
   a pumping chamber on said frame including peristaltic pumping means for progressively squeezing and releasing consecutive portions of an intermediate section of said tubing to pump fluid in said tubing in a predetermined direction; and
   tubing feeding means on said frame comprising powered frictional gripping means to engage the outer periphery of said tubing, on sections adjacent to either side of said tubing intermediate section, and feed said tubing through said feeding means and said pumping chamber in said predetermined direction at a controlled rate during pumping of said fluid.

7. The peristaltic pump of claim 6 wherein said tubing feeding means is operable to control the tubing feeding rate independently of said peristaltic pumping means.

8. The peristaltic pump of claim 6 wherein said tubing gripping means comprises a frictionally engaging powered wheel for contacting said outer periphery of said tubing.

9. A peristaltic pump which utilizes a length of elastic tubing in effecting pumping action comprising:
   a frame;
   a pumping chamber on said frame including peristaltic pumping means for progressively squeezing and releasing consecutive portions of an intermediate section of said tubing to pump fluid in said tubing in a predetermined direction; and
   tubing feeding means on said frame comprising gripping means to engage the outer periphery of said tubing, on at least one section adjacent to said tubing intermediate section, and feed said tubing through said pumping chamber in said predetermined direction at a controlled rate during pumping of said fluid, said tubing feeding means being drivingly connected to said peristaltic pumping means to provide power to said tubing feeding means.

10. A peristaltic pump which utilizes a length of elastic tubing in effecting pumping action comprising:
   a frame;
   a pumping chamber on said frame including peristaltic pumping means for progressively squeezing and releasing consecutive portions of an intermediate section of said tubing to pump fluid in said tubing in a predetermined direction; and
   tubing feeding means on said frame comprising a powered wheel and idler roller to engage the outer periphery of said tubing, on at least one section adjacent to said tubing intermediate section, and feed said tubing through said pumping chamber in said predetermined direction at a controlled rate during pumping of said fluid.

11. The peristaltic pump of claim 10 wherein said tubing feeding means is adapted to engage said tubing on sections adjacent to either side of said tubing intermediate section to feed one of aid adjacent tubing sections into said pumping chamber and to feed the other of said adjacent tubing sections out of said pumping chamber.

12. A peristaltic pump which utilizes a length of elastic tubing in effecting pumping action comprising:
   a frame;
   a pumping chamber on said frame including peristaltic pumping means for progressively squeezing and releasing consecutive portions of an intermediate section of said tubing to pump fluid in said tubing in a predetermined direction; and
   tubing feeding means on said frame comprising gripping means to engage the outer periphery of said tubing, on sections adjacent to either side of said tubing intermediate section, and feed said tubing through said pumping chamber in said predetermined direction at a controlled rate during pumping of said fluid, said tubing feeding means being drivingly connected to said peristaltic pumping means to provide power to said tubing feeding means.

13. A peristaltic pump which utilizes a length of elastic tubing in effecting pumping action comprising:
   a frame;
   a pumping chamber on said frame including peristaltic pumping means for progressively squeezing and releasing consecutive portions of an intermediate section of said tubing to pump fluid in said tubing in a predetermined direction; and
   tubing feeding means on said frame comprising a powered wheel and idler roller to engage the outer periphery of said tubing, on sections adjacent to either side of said tubing intermediate section, and feed said tubing through said pumping chamber in said predetermined direction at a controlled rate during pumping of said fluid.

* * * * *

UNITED STATES PATENT AND TRADEMARK OFFICE

CERTIFICATE OF CORRECTION

PATENT NO. : 4,906,168

DATED : March 6, 1990

INVENTOR(S) : Ronald E. Thompson

It is certified that error appears in the above-identified patent and that said Letters Patent is hereby corrected as shown below:

In the Specification:

Column 4, line 54, after "by" insert --prior art mechanisms. The use of feeding drive on both--.

In the Claims:

In claim 1 at column 5, line 21 delete "is" and substitute therefor --in--.

In claim 2 at column 5, line 23, delete "I" and substitute therefor --1--.

In claim 11 at column 6, line 31 delete "aid" and substitute therefor --said--.

Signed and Sealed this

Twenty-sixth Day of February, 1991

*Attest:*

HARRY F. MANBECK, JR.

*Attesting Officer*

*Commissioner of Patents and Trademarks*